United States Patent [19]

DiNatale et al.

[11] Patent Number: 4,551,784

[45] Date of Patent: Nov. 5, 1985

[54] CORONA GENERATING DEVICE

[75] Inventors: Ernest L. DiNatale, Rochester; Robert J. Yax, Marion, both of N.Y.

[73] Assignee: Xerox Corporation, Stamford, Conn.

[21] Appl. No.: 626,518

[22] Filed: Jun. 29, 1984

[51] Int. Cl.[4] ..... H01T 19/04

[52] U.S. Cl. ..... 361/225; 55/140; 55/151; 200/61.18; 200/79; 250/324; 361/213; 361/229; 361/230

[58] Field of Search ..... 361/212–214, 361/220, 222, 225, 229, 230, 235; 250/324; 55/140, 147, 151, 153, 157; 200/79, 61.18, 61.08

[56] References Cited

U.S. PATENT DOCUMENTS

| | | | |
|---|---|---|---|
| 3,309,575 | 3/1967 | Lee et al. . | |
| 3,457,405 | 7/1969 | Del Vecchio et al. | 361/230 |
| 3,526,811 | 9/1970 | Shrader . | |
| 3,584,258 | 6/1971 | Barnett . | |
| 3,609,484 | 9/1971 | Sakamaki et al. . | |
| 3,805,069 | 4/1974 | Fisher . | |
| 3,908,127 | 9/1975 | Clark | 361/230 X |
| 3,980,929 | 9/1975 | Bresnick . | |
| 4,112,298 | 9/1978 | Weikel, Jr. | 250/324 |
| 4,130,852 | 12/1978 | Peffer et al. | 361/213 |
| 4,203,144 | 5/1980 | Okamoto | 361/230 X |

*Primary Examiner*—Harry E. Moose, Jr.

[57] ABSTRACT

A corona generating device together with a coronode wire end block assembly is described, wherein the end block includes a spring member adapted for connection to a coronode wire which operates as a circuit breaker at the contact point of the end block thereby terminating the power supply, and preventing a potentially dangerous and destructive arcing situation in the event the wire ruptures. In a preferred embodiment the end block assembly comprises a conductive electrode having at one end a coronode contact and, at the other end a conductive plug adapted for engagement with a power supply contact, with the electrode being positioned in an electrically insulating holder between the coronode contact and the conductive plug. The conductive spring is mounted to the electrically insulating holder on one side of the coronode contact with the other end of the conductive spring being connected to the coronode wire. The device further includes a spring means to tension the coronode wire and the spring such that the spring means is in electrical contact with the coronode contact, whereby the coronode wire may be energized and wherein in the event that the coronode wire ruptures, the spring acts as a circuit breaker returning to its untensioned position breaking electrical contact with the coronode contact.

11 Claims, 6 Drawing Figures

CORONA GENERATING DEVICE

BACKGROUND OF THE INVENTION

This invention relates to an electrostatographic reproducing apparatus and more particularly to a novel corona generating device together with an end block assembly designed to minimize the occurrence of hazardous or unsafe conditions.

In an electrostatographic reproducing apparatus commonly used today, a photoconductive insulating member is typically charged to a positive potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

In such electrostatographic apparatus in use today, corona generating devices are used for several purposes; to initially uniformly charge the electrostatographic imaging member, to electrostatically transfer the toner particles from the imaging member to a receiving surface such as ordinary paper, to detack the transfer member (copy paper) from the imaging member. In certain machine configurations, corona generating devices may also be used as pre-charge corotrons, pre-transfer corotrons, and preclean corotrons.

Typically these charging devices comprise a corona discharge wire made of tungsten, stainless steel, or platinum of about 0.5 mm to 0.15 mm, preferably 0.1 mm in diameter spaced in opposed relation with the surface of the photosensitive member. A high voltage is applied across the wire thereby producing the corona discharge, which imparts the electrostatic charge to the surface of the photosensitive member.

Since a high voltage is applied, the corona discharge wire is gradually corroded and deteriorated so that the tensile strength of the wire may be so reduced as to cause the breakage. Furthermore, when the toner or the like is attached to the corona discharge wire, the corona discharge tends to be concentrated at one portion so that a spark discharge may be produced thereby causing the breakage of the wire. In some cases, the copying paper is wrapped around the charging device and brought into contact with the corona discharge wire, thus resulting in the breakage. When a fractured live wire is present, arcing and sparking may rapidly occur and the electrophotographic apparatus itself may be damaged and an operator may suffer electric burns or shock by contacting the wire.

Furthermore, when the live fractured wire contacts the photosensitive member, it may damage the photosensitive member in effect burning off the photosensitive coating on the member which depending on the materials that it contains, may result in the evolution of toxic or noxious fumes. Accordingly, when a high voltage coronode wire does rupture, a cause for customer concern and safety are presented.

While, as discussed above, the wire may be fractured as a result of gradual corrosion or deterioration it should be noted that a number of external factors may also contribute to fracture of a coronode wire, including such diverse things as machine vibration, chance contact by any conductive member upon which the coronode wire tends to melt including contact by a plurality of conductive fibers in the surrounding air.

PRIOR ART

To eliminate these problems, it has been proposed to bias a corona discharge wire retaining member by a spring in such a manner that when the wire is broken, the retaining member is caused to move outwardly, thereby actuating a switch or the like so as to interrupt a low voltage source such as the primary of a transformer. In this way the charging device must be provided with a high voltage circuit for charging and a low voltage circuit for safeguarding the device thereby increasing the space required in the device and the fabrication cost. Even when a quick-to-respond microswitch is used, a torque or the order of 5 to 10 gr.-cm is required for actuating this microswitch. Thus, a large tension is required for the wire. On the other hand, the discharge cannot be produced efficiently at a relatively low voltage unless the diameter of the corona discharge wire is made smaller (generally 0.0 to 0.08 mm.). Therefore, greater tension may not be applied to the wire because breakage will occur at once. Thus fabrication has been difficult.

Alternatively the power supply may be supplied with a current limiter such that upon fracture of the wire and arcing, the current limiter detects a high jump in the current and thereafter shuts down the power supply. Similarily arc detectors may detect the presence of an arc and once again shut down the power supply.

An other alternative technique is that described in U.S. Pat. No. 3,609,484 (Sakamaki et al.) which as illustrated in FIG. 2 solves the above noted problem with the use of an elastic retaining member or a spring biased retaining member for the corotron wire such that when a corona wire is fractured, it is biased directly and immediately into engagement with a short circuit electrode with a path to ground. While this device is capable of providing an open circuit and thereby reducing the arcing problem, it should be noted that it does require a second electrode as well as a special design so that it can be readily grounded. The fact that it has to be readily designed for grounding can create machine design problems in that corona generating devices are frequently placed in locations, which are not easy to ground or have to be grounded in different ways, thus substantially reducing the interchangeability of the same corona generating device in different portions of a machine for different functions.

Accordingly, there is a continuing need for a simple, low cost, reliable safe device which prevents live corona generating wires which have been fractured from arcing or damaging photoconductive materials with the emission of toxics or noxious fumes or presenting a safety hazard by way of shocking or burning the operator.

It is a further desire to provide corona generating devices which have utility for more than one function and in more than one location in an automatic reproducing apparatus.

SUMMARY OF THE INVENTION

In accordance with the present invention, a corona generating device together with a specially designed end block assembly which acts as a circuit breaker in the event that a corona wire ruptures, is provided.

In accordance with the principal aspect of the present invention, the corona generating device comprises at least one coronode wire supported between a first and second end block assembly, one of the end block assemblies comprising a conductive electrode having at one end a coronode contact and at the other end a conductive plug adapted for engagement with the power supply contact. The electrode is positioned in an electrically insulating holder between the coronode contact and the conductive plug with the electrically insulating holder having at one end a conductive spring means mounted thereto on one side of the coronode contact with the other end of said conductive spring being connected to the coronode wire. The corona generating device further includes tensioning means to tension a coronode wire and spring means such that the spring means is in electrical contact with the coronode contact, whereby the coronode wire may be energized and wherein in the event that the coronode wire ruptures, the spring acts as a circuit breaker returning to its untensioned position, breaking electrical contact with the coronode contact.

In a specific aspect of the present invention, the coronode wire and the spring means are tensioned around a vertically oriented insulating post member connected to the insulating holder.

In a further aspect of the present invention, the spring means comprises a leaf spring which is in area contact with the coronode contact.

In a further aspect of the present invention, the coronode contact comprises the end of a vertically oriented post in the insulating end block assembly.

In a further aspect of the present invention, the corona generating device includes a conductive shield extending and supported from the first end block assembly to the second end block assembly.

For a better understanding of the invention as well as other aspects and further features thereof reference is had to the following drawings and description.

DESCRIPTION OF THE PREFERRED EMBODIMENT

The invention will now be described with reference to a preferred embodiment.

Figure 1:
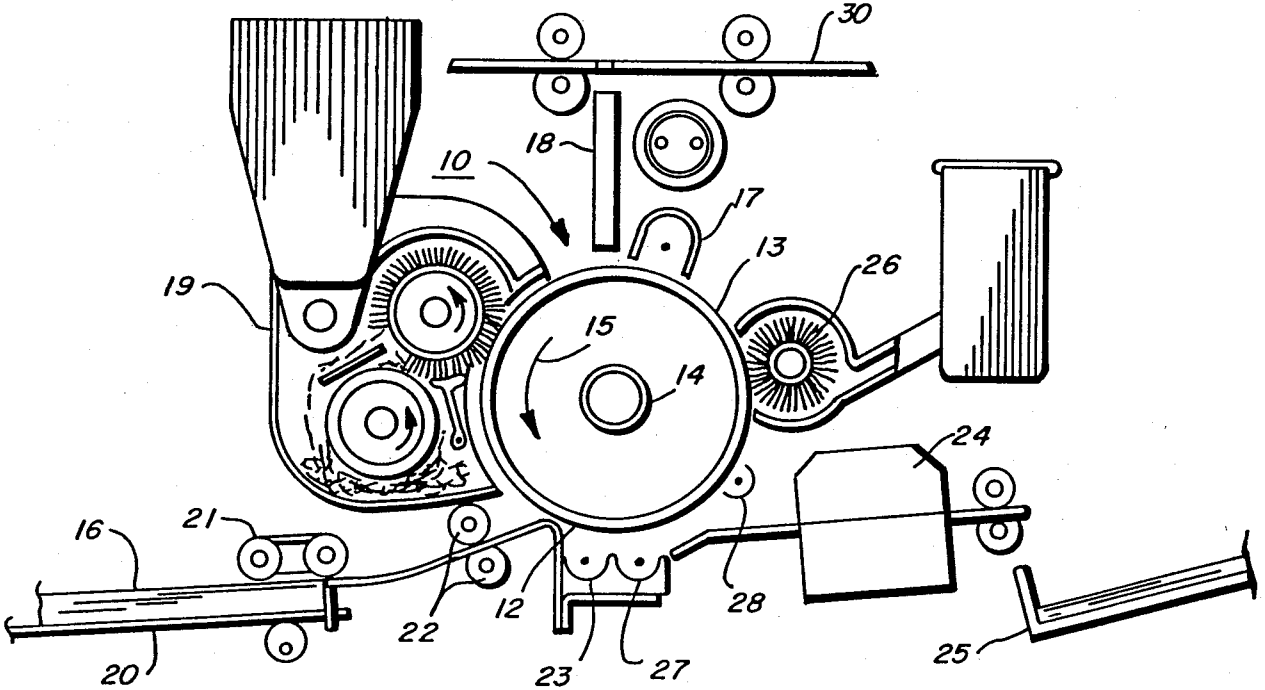
FIG. 1 is a schematic representation in cross-section of an automatic electrostatographic reproducing machine with a corona generating device according to the present invention uses the charge corotron.

Referring now to FIG. 1, there is shown by way of example an automatic xerographic reproducing machine 10 which includes the corona generating device of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 rotates to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator feed belt 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. Following transfer of the toner image to the final support material, the residual charge remaining on the drum is reduced by the corona generated from the pre-clean corotron 28 according to the present invention.

It is believed that the foregoing general description is sufficient for the purposes of the present application to illustrate the general operation of an automatic xerographic copier which can embody the apparatus according to the present invention.

Referring more specifically to FIGS. 2 through 6 wherein a preferred embodiment of the corona generating device according to the present invention is illustrated in greater detail. It will be understood that such a device may be used as any one or more of the charging devices 17, 23,27 or 28 illustrated in FIG. 1.

Figures 2, 6:
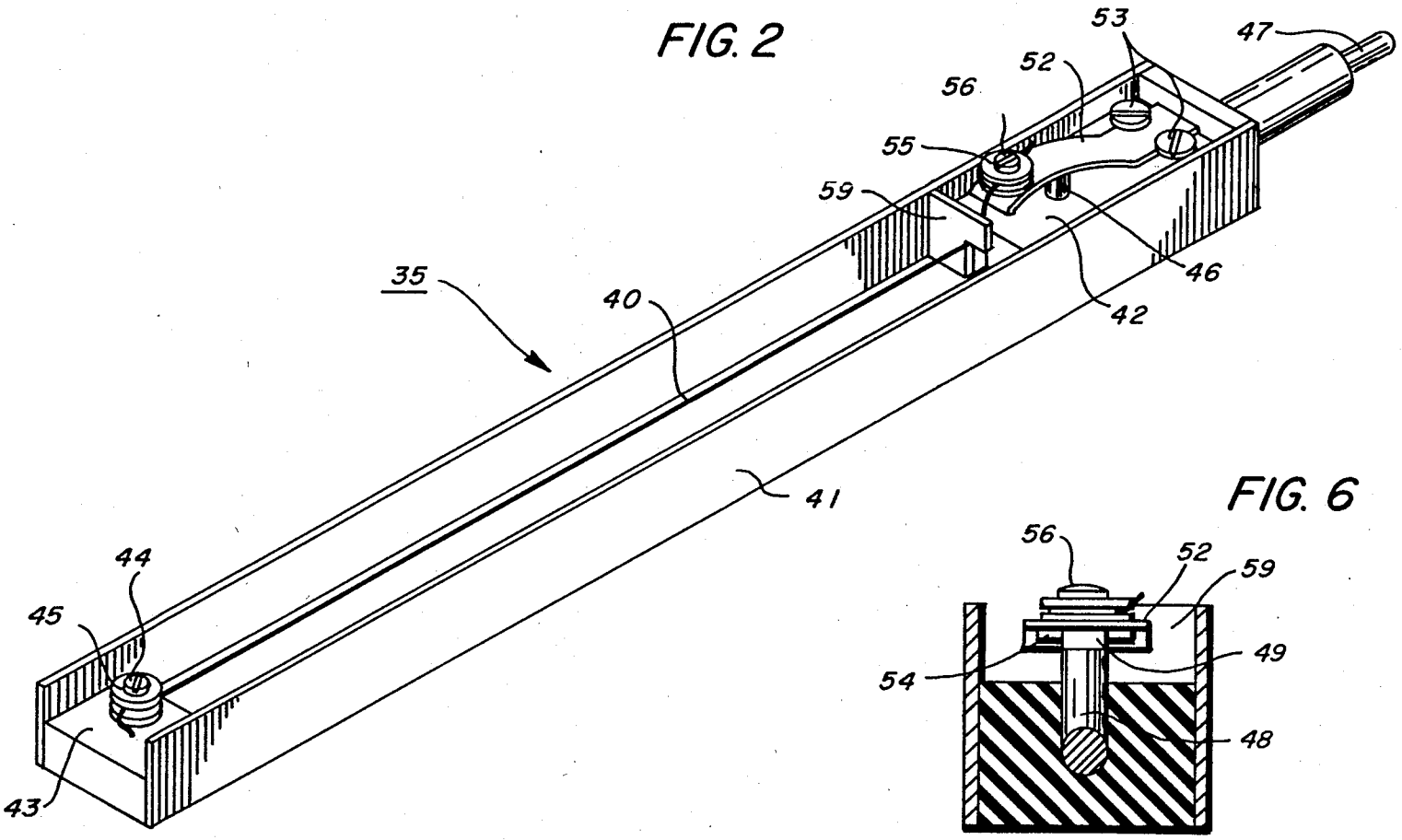
FIG. 2 is an isometric view of the corona generating device according to the present invention.
FIG. 6 is a section taken along the line AA of FIG. 4 showing the contact between the leaf spring 52 and the coronode contact 48 to be an area contact as opposed to a point contact.

As indicated in FIG. 2 the corona generating device 35 has a coronode wire 40 is stretched between end block 42 and end block 43 being fastened at end block 43 by having the wire 40 wrapped around and screwed down by screw 44 with washer 45 in between the screw head and the end block 43. The coronode wire 40 is protected along its entire length by means of shield 41 which may surround as much of the coronode opening as desired in order to suitably protect the wire. At the other end of the corona charging device is the circuit breaker end block 42 according to the present invention. As illustrated this end block comprises a conductive electrode 46 having a conductive plug 47 at one end for engagement with the power supply contact of the electrostatographic reproducing machine and having at its other end a coronode contact member 48 having at its contact surface a brass tip 49 to insure good electrical contact with the conductive spring member. The electrode 46 is contained within end block 42 made of insulating material which may be shaped in any desired configuration to satisfy mounting requirements within the corona generating device or shield member or other members in which the end block may be mounted. A spring 52 made of an electrically conductive material is mounted to the top of the insulating end block 42 by means of two screws 53, one on either side of the leaf spring 52 holding the leaf spring in position. (See FIG. 3).

Figure 3:
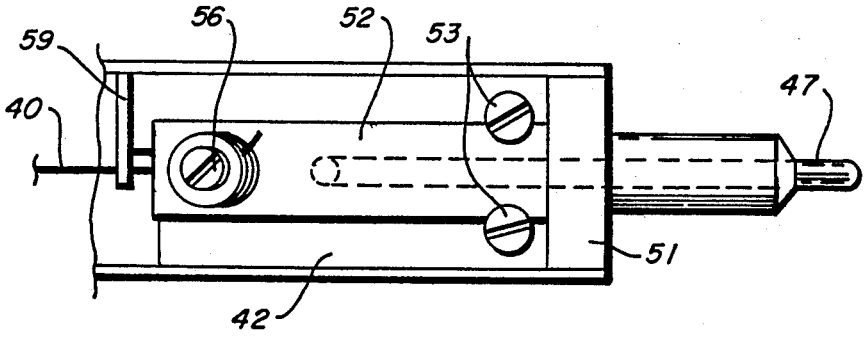
FIG. 3 is a plan view of one end of the corona generating device according to the present invention.
Figure 4:
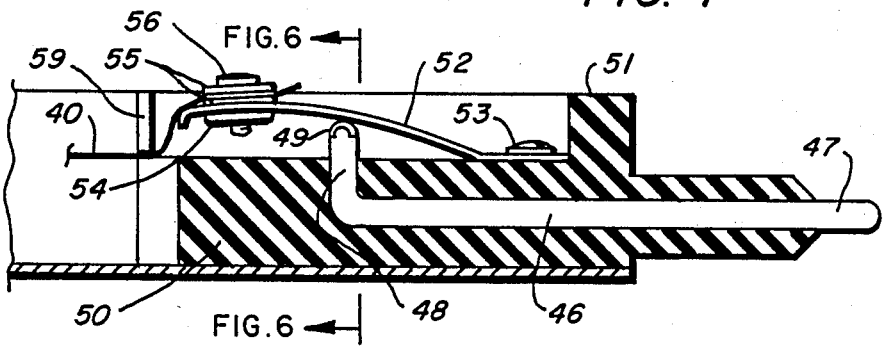
FIG. 4 is a side view of one end of the corona generating device according to the present invention.
Figure 5:
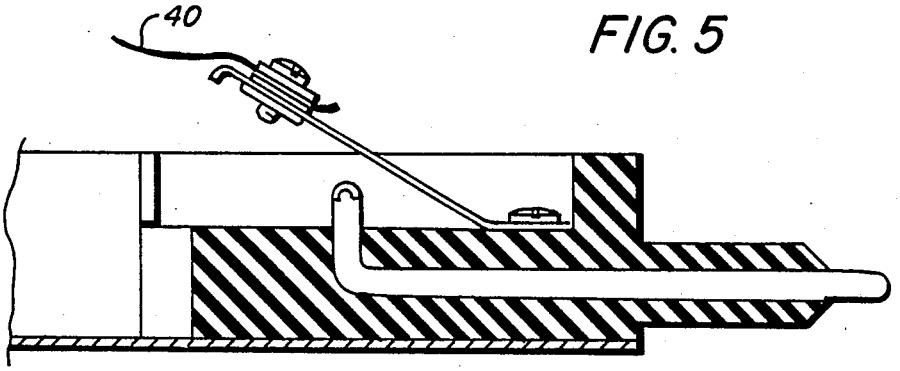
FIG. 5 is a side view of the corona generating device according to the present invention wherein the coronode wire has been fractured with the spring acting as a circuit breaker.

As illustrated in FIGS. 3 and 4, the other end of the leaf spring 52 stretches over the coronode contact 48 and has corona wire mounting means at the end thereof including a nut 54 which has been welded to the bottom of leaf spring 52 into which the screw 56 may be inserted. The corona wire is fastened to the leaf spring through the screw 56 and washers 55 by wrapping the corona wire 40 around the screw post between the washers 55 and tightening the screw. The spring is tensioned by means of insulating tensioning member 59 which comprises a generally vertically oriented post so that the corotron wire at the circuit breaker end of the device is in the same general spaced location as it is in the opposite end block of the corona generating device.

The illustrated corona generating device may be readily assembled by inserting the two insulating screws 53 in the top of the insulator end block 42 and placing the leaf spring 52 under the heads of the screws, making sure that the end is up against the back stop 51 of the block 42. Thereafter both screws may be tightened to secure the springs position. The corona wire may then be strung by placing the end of the wire between the two washers 55 mounted on the spring through means of screw 56 and nut 54. The screw 56 may then be tightened to pinch the wire between the washers with the outboard end pointing toward the opposite end of the corona generating device. The corotron wire is then positioned under the tensioning tab 59 of the inboard end block and the wire strung over the screw 44 and under the washer 45 at the outboard end block 43. A suitable tension of the order of 1 to 2 pounds may be applied to the corona wire making sure that the spring has been pulled down to provide an area contact with the coronode contact as illustrated in FIG. 4. Once this has been accomplished the screw is tightened at the outboard end block.

In operation the corona generating device may be suitably placed in the machine with the conductive plug 47 inserted in the power supply which once activated and by virtue of the intimate contact between leaf spring 52 and coronode contact 48 provide high voltage supply to the coronode wire 40, thereby providing a corona generator. If for any reason the coronode wire 40 is ruptured the tension in the spring 52 is immediately terminated upon which the spring by virtue of its spring force will return to its untensioned position away from contact with the corona contact 48 thereby severing electrical contact with the power supply so that the ruptured corona wire is dead, see FIG. 5. In this manner once a corona wire is ruptured and/or fractured, the spring pops up acting as a circuit breaker breaking connection with the power supply and minimizing the potential for arcing and destruction of photoreceptor surfaces as well as providing a safe shock proof environment for the operator. Accordingly the present invention provides a relatively simple, low cost, highly reliable device which prevents a live corotron wire from discharging a photoreceptor causing damage thereto and emitting toxic or noxious fumes. It also provides a safe device in the event of corotron rupture whereby the occurrence of operator shock may be minimized.

The disclosures of all the patents referred to herein are specifically incorporated in their entirety herein by reference.

While the above invention has been described with reference to specific embodiments, it will be apparent to those skilled in the art that many alternatives, modifications and variations may be made. In particular, while the invention has been described with reference to a particular spring arrangement for the corotron wire, other arrangements may be employed performing the same function. For example, instead of the spring being mounted on the insulating end block as illustrated it could be mounted on a slip ring which slips over the high voltage contact plug of the illustrated coronode end block. Accordingly, it is intended to embrace such modifications and alternatives as may fall within the spirit and scope of the appended claims.

What is claimed is:

1. A corona generating device comprising at least one coronode wire supported between first and second end block assemblies, one of said first or second end block assemblies comprising a conductive electrode having at one end a coronode contact and at the other end a conductive plug adapted for engagement with a power supply contact, said electrode being positioned in an electrically insulating holder between said coronode contact and said conductive plug, said electrically insulating holder having one end of a conductive spring means mounted thereto on one side of said coronode contact with the other end of said conductive spring means being connected to said coronode wire, said corona generating device further comprising means to tension said coronode wire and said spring means such that said spring means is in electrical contact with said coronode contact whereby said coronode wire may be energized and wherein in the event said coronode wire ruptures the spring acts as a circuit breaker returning to its untensioned position breaking electrical contact with said coronode contact.

2. The corona generating device of claim 1, wherein said coronode contact provides an area contact.

3. The corona generating device of claim 1, wherein said spring means is a leaf spring.

4. The corona generating device of claim 1, wherein said coronode wire and said spring means are tensioned around a vertically oriented insulating post member connected to the insulating holder.

5. The corona generating device of claim 2, wherein said coronode contact area is the end of a vertically oriented post.

6. The corona generating device of claim 1, further including a conductive shield extending from said first end block to said second end block.

7. An end block for a corona generating device comprising a conductive electrode having at one end a coronode contact and at the other end a conductive plug adapted for engagement with a power supply contact, said electrode being positioned in an electrically insulating holder between said coronode contact and said conductive plug, said electrically insulating holder having one end of conductive spring means mounted thereto on one side of said coronode contact with the other end of said conductive spring means being adapted for connection to said coronode wire, said end block further comprising means to tension a coronode wire and said spring means such that said spring means is in electrical contact with said coronode contact whereby a coronode wire when connected to said spring means may be energized and wherein in the event said coronode wire ruptures the spring acts as a circuit breaker returning to its position untensioned breaking electrical contact with said coronode contact.

8. The end block of claim 7, wherein said coronode contact is an area contact.

9. The end block of claim 7, wherein said spring means is a leaf spring.

10. The corona generating device of claim 7, wherein said coronode contact area is the end of a vertically oriented post.

11. The end block of claim 7, wherein said tension means comprises a vertically oriented insulating post member connected to the insulating holder around which said coronode wire and said spring means may be placed in tension.

* * * * *